US005979062A

United States Patent [19]

Prosan

[11] Patent Number: 5,979,062

[45] Date of Patent: Nov. 9, 1999

[54] PAPER CUTTING ASSEMBLY

[76] Inventor: Scott Prosan, 11721 SW. 119th Place Rd., Miami, Fla. 33186

[21] Appl. No.: 09/066,200

[22] Filed: Apr. 24, 1998

[51] Int. Cl.[6] ..... B26B 29/00

[52] U.S. Cl. ..... 30/282; 30/294; 83/649; 83/614

[58] Field of Search ..... 83/614, 649, 821, 83/949; 30/124, 136, 136.5, 292, 294, 282

[56] References Cited

U.S. PATENT DOCUMENTS

| | | | |
|---|---|---|---|
| 1,740,018 | 12/1929 | Jensen | 30/294 |
| 2,677,180 | 5/1954 | Schierghofer | 30/292 |
| 3,504,435 | 4/1970 | Sloboda et al. | 30/294 X |
| 3,934,341 | 1/1976 | Carlson | 30/294 X |
| 4,693,004 | 9/1987 | Plana | 30/292 X |
| 5,075,974 | 12/1991 | Mcllhatten | 30/294 X |
| 5,325,594 | 7/1994 | Szafranski | 30/294 |

*Primary Examiner*—Rinaldi I. Rada
*Assistant Examiner*—Ana Luna
*Attorney, Agent, or Firm*—Malloy & Malloy, P.A.

[57] ABSTRACT

A cutting assembly structured to cut sheets of paper or a like material from a supply roll, the assembly including a base having a guide assembly and at least one cutting blade disposed in a predetermined cutting orientation. The guide assembly includes a contact portion which is configured to substantially conform to the outer surface configuration of the supply roll so as to facilitate sliding engagement of the contact portion with the supply roll as the base is moved along a length thereof. Moreover, the cutting blade is disposed in the base such that the sheet of material is guided thereto as the base is passed across the sheet of material, and the contact portion and cutting blade are cooperatively disposed and structured relative to one another so as to maintain the cutting blade in the cutting orientation and at a substantially constant spacing relative to the supply roll and the sheet of material being cut as the base is moved along the length of the supply roll.

14 Claims, 3 Drawing Sheets

FIG. 1
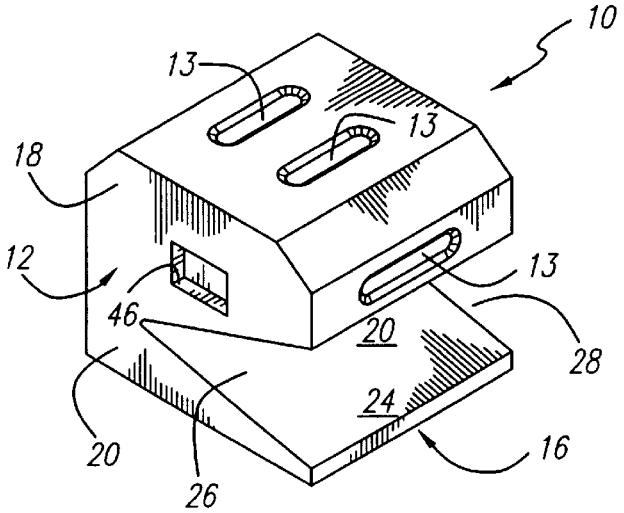
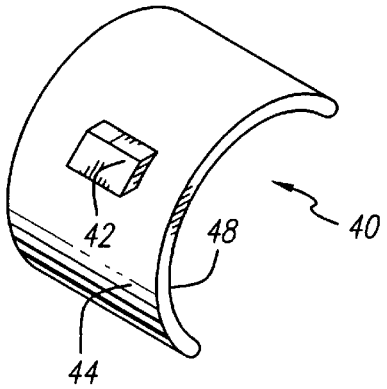
FIG. 2
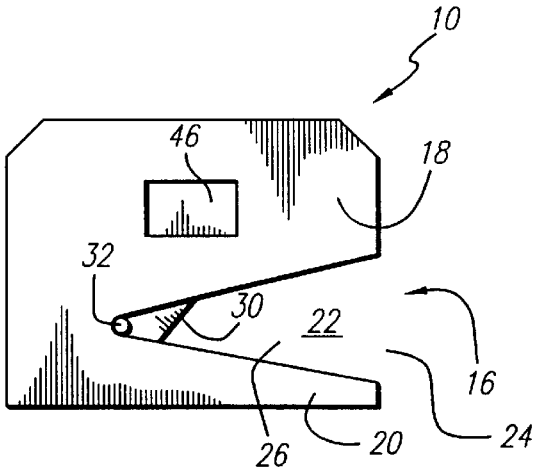
FIG. 3

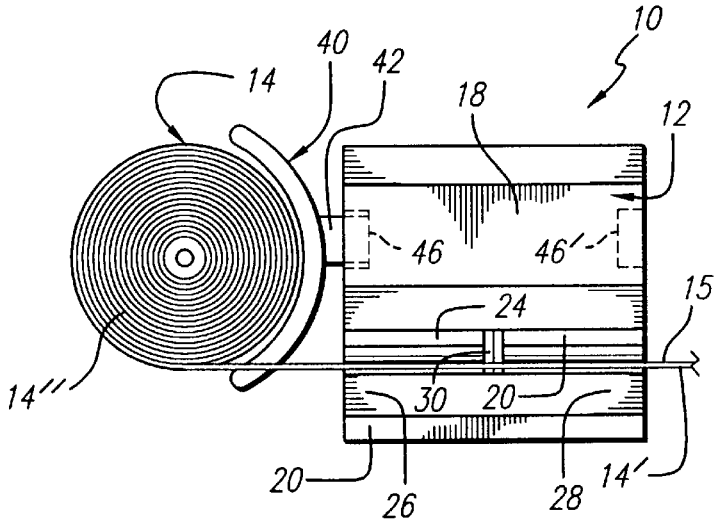
FIG. 4
FIG. 5
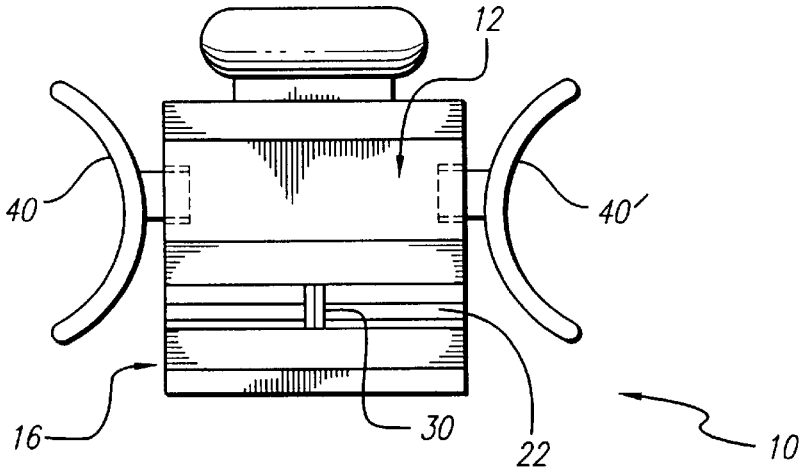
FIG. 6
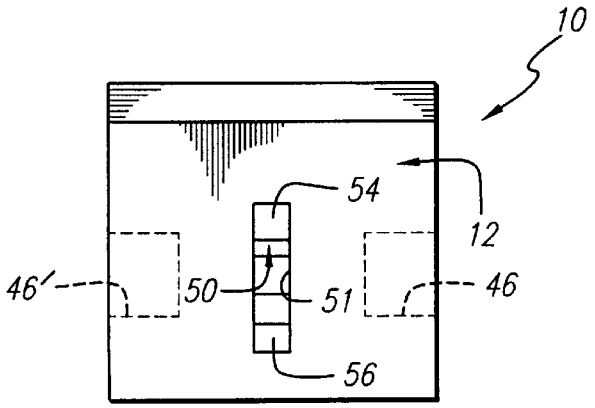

PAPER CUTTING ASSEMBLY

BACKGROUND OF THE INVENTION

1. Field of the Invention

This invention relates to a cutting assembly for cutting sheets of paper or other material from a supply roll of such material, wherein the cutting assembly is easily manipulable and movable relative to the supply roll to accomplish severing of the sheet therefrom in a uniform manner. The cutting assembly includes a guide member structured to facilitate proper positioning of a cutting blade at a substantially constant spaced distance from the supply roll without requiring a large mechanism in a pre-defined work space.

2. Description of the Related Art

Typically, the dispensing of wrapping paper and like materials such as aluminum foil, plastic wrap, wax paper, etc. from a supply roll of such material is accomplished through the use of a scissor or like cutting implement, or the provision of a cutting blade mounted on an exterior of a packaging container for the wrapping paper or the like. The conventional design for such cutting and/or dispensing devices often involves the placement of the elongated supply roll of such material on the interior of a container having a cutting blade mounted substantially adjacent an opening of the container. As such, when the container is first opened a length of material to be cut is pulled out, away from the roll and along the cutting edge of the blade attached to the container. The container may then be closed and the sheet of material being cut is manipulated or pulled downwardly or otherwise manipulated for positioning against the cutting edge of the blade.

Devices of the type set forth above have been known and commercially available for a number of years. However, these known structures and procedures are generally only considered for dispensing sheets of material from supply rolls wherein it is acceptable for those materials to come prepacked. Moreover, such assemblies do not generally achieve a uniform and smooth cut. As such, attempts have been made to improve the dispensing of sheets of a variety of different materials in a manner which avoids a ragged or uneven edge being formed on the sheet of material being cut as well as rendering the act of dispensing and cutting such sheets more efficient.

When dealing with paper sheets, however, a further limitation to the type of cutting mechanism relates to the fact that the rolls of paper or like material are generally not commercially available prepackaged in containers having preformed cutting blades thereon. Such materials range from decorative, holiday wrapping paper to much larger supply rolls of material designed for commercial or retail use. When dealing with such materials, the size and necessary retail cost of such products make it impractical and overly expensive to place such rolls within a separate container, especially because of the desirability to have the exterior of the paper visible to a consumer for effective product selection at a point of purchase. As such, when a consumer purchases such rolls, they must use a conventional cutting device, or in the case of larger commercial rolls, larger support racks and attached cutting facilities may be available such that a substantially large supply roll of the material to be dispensed is mounted on the supporting rack or frame. In those large, commercial devices a cutting blade is fixedly or movably attached to the frame and is positioned in a cutting orientation relative to a leading portion of the material being dispensed from the supply roll. These more commercially oriented devices also may include fixed guides or like structures which attempt to orient or position a leading portion of the material, as it is pulled from the roll, in a proper position relative to a cutting blade to accomplish a clean "cutting line" thereon, thereby avoiding the problems of ragged, uneven borders on the sheet of material being dispensed. While such structures are operative for their intended purpose they are specifically designed for the aforementioned retail and/or industrial usage. As a result, such "fixed" dispensing and cutting structures are not readily adaptable for use in the removal and separation of sheets of paper or like material from smaller sized supply rolls.

As indicated, decorative wrapping paper and other similar materials are frequently sold or available to the consuming public absent any combined container and cutting structure such as is common with aluminum foil. Wrapping paper rolls are generally packaged in transparent wrapping material so that the consumer may clearly view the color, designs or other decorative features of the wrapping paper. Once put in use, wherein a user desires to remove a sheet portion from the supply roll, such user must rely on other more conventional cutting instruments such as scissors or like cutting instruments. While these conventional instruments are designed to adequately remove a sheet of paper of any desired dimension from a roll of stock, the bordering edge of the removed sheet is frequently ragged and uneven. This may result in an unsightly exposure of such ragged edges such as when the paper is used to wrap holiday presents or other gifts. In order to overcome the above set forth problems existing in the area of dispensing sheets of paper or like material from a stock roll there is a need for a preferred cutting assembly which is preferably includes a guide structure and is capable of forming a clean, smooth edge or border along the cutting line, as the sheet is severed from the stock supply roll. In addition, such a preferred cutting assembly should be capable of quickly and effectively severing sheets of material from stock rolls of different sizes. The structure of such a preferred cutting assembly should be such as to allow it to be sufficiently light weight to be hand-held, so that it can move freely or otherwise be manipulated relative to the supply roll and the sheet of material being cut therefrom. The design and overall configuration of such a cutting assembly should be sufficiently versatile to permit its mounting on some type of mounting frame which may support a roll of stock material, if such utilization is applicable for the intended user. In addition, the overall structural design of such a preferred cutting assembly should be capable of being used in combination with other somewhat conventional cutting instruments such as a knife blade, scissors, letter opener, or the like. Alternately, the preferred cutting assembly could be equipped with a prefixed cutting blade which is properly oriented in a cutting position to accomplish clean, smooth and efficient severing of a plurality of sheets from the roll of supply material.

SUMMARY OF THE INVENTION

The present invention relates to a cutting assembly specifically designed to sever and thereby remove sheets of material from a supply or stock roll of such material. Moreover, the cutting assembly of the present invention is adapted to be used in cutting and removing sheets of wrapping paper, or any other applicable materials of the type which do not come prepackaged in a container of the type having a cutting blade associated therewith.

In a preferred embodiment of the present invention to be discussed in greater detail hereinafter, the dimension, configuration and overall structure of the subject cutting assembly facilitate its use as a portable cutting device to the extent that the assembly may be operatively positioned while being held in one hand of a user, and does not require a specialized work area or mounting structure. Nevertheless, the structure of the subject cutting assembly is sufficiently versatile to contemplate its mounting or attachment to a variety of other types of support or mounting frames which are designed to have a supply roll of material mounted thereon, if desired.

More specifically, the cutting assembly of the present invention comprises a base including a receiving portion defined by a substantially fixed jaw like configuration including a top portion and a bottom portion integrally secured to the base. An opening defined by an open front and oppositely disposed open sides are formed in the base between the top and bottom portions thereof and further defines the receiving portion.

At least one cutting blade is mounted on the base substantially within the opening of the receiving portion and is effectively shielded from exposure of the cutting edge thereof to the exterior portions of the base. This placement of the cutting blade is provided for the safety of the user such that the user's hand or fingers cannot be inadvertently injured. The safe use of the subject cutting assembly is further enhanced by specifically dimensioning the opening to restrict the entrance of a user's finger, or other portions of his body, from coming into contact with the cutting edge of the blade. The receiving portion is therefor structured in cooperation with the cutting blade so as to receive and facilitate the sheet portion of the material being severed from the supply roll thereof. In additional embodiments of the present invention the cutting blade may be removably mounted on the base and be defined by what may be considered a "conventional" cutting tool such as a knife blade, scissors, letter opener, etc. When such a conventional cutting instrument is used, the base is structured to include a positioning channel or passage formed therein such that the leading end of the knife blade or like instrument passes along such channel or passage and into the opening which, as set forth above, serves to at least partially define the receiving portion of the casing. When oriented in the proper and preferred cutting orientation, the cutting edge of the conventional cutting or slicing instrument is exposed within the receiving portion. Typically a knife, pair of scissors, etc., due to its elongated configuration will protrude outwardly from the base and include a handle or like structure thereon located in a position to be gripped by the user of the subject cutting assembly. When so gripped, the handle of the conventional instrument can be used to position or otherwise manipulate the base relative to the sheet of material being cut and the supply roll from which it is dispensed in order to operate the cutting assembly.

Regardless of the various embodiments of the cutting blade used in combination with the base, as set forth above, an important additional feature of the present invention is the provision of a guide assembly. The guide assembly includes a contact portion which protrudes outwardly from one side or face of the base. The contact portion is at least partially configured to slidingly engage the supply roll of material along the length thereof. The guide assembly, including the contact portion, is mounted on or attached to the base so as to move the base, with the contact portion mounted thereon, continuously along the length of the roll. The disposition of the contact portion of the guide assembly and its cooperative structuring and configuration relative to the placement of the cutting blade in the aforementioned cutting orientation, will serve to maintain a substantially constant spacing of the cutting blade from the exterior of the supply roll. Therefore, as the leading portion of the material is removed from the supply roll and positioned within the receiving portion in proper orientation relative to the cutting blade, the user of the subject assembly places the contact portion of the guide assembly in contact with the outer surface of the supply roll. A pushing or sliding motion is then applied to the base with the contact portion being maintained in sliding engagement with the outer surface of the supply roll. The result will be a clean, smooth, bordering edge on the sheet of material being cut which will define the cutting line of the cutting blade as the sheet of material is severed from the supply of material on the stock roll.

The aforementioned guide assembly further includes an attachment structure which facilitates proper placement and orientation of the contact portion thereof relative to the exterior of the base so as to slidingly engage the exterior surface of the supply roll in the intended fashion as the base and contact portion are moved along the length of the supply roll. While a variety of different structural designs may be incorporated in both the guide assembly and the base to accomplish proper mounting and/or attachment of the contact portion to the base, it should be emphasized that the contact portion should preferably be capable of being positioned in at least two operative positions. This will enable the subject cutting assembly to be manipulated in its intended fashion by either a right handed or left handed person. More specifically, the base, with the contact portion attached thereto may be moved along the length of the supply role to accomplish severing of a sheet of material therefrom in either of two opposite directions, therefore, the cutting assembly of the present invention contemplates the removable positioning of the contact portion on the base such that the base may travel along the length of the roll in each of the aforementioned opposite directions. Alternately, more than one contact portion may be included within the aforementioned guide assembly such that removal and reattachment becomes unnecessary. Yet another embodiment contemplated in the cutting assembly of the present invention would be the movable, verses the removable attachment of the contact portion to the base so that the contact portion may be selectively positioned, such as by pivoting, in either of at least two operative positions. This would allow the base and contact portion to be moved along the length of the supply roll in either of two opposite directs to accomplish severing or cutting of the sheet from the supply roll.

Therefore, it is a primary object of the present invention to provide a cutting assembly which is designed to sever a sheet of material from a supply roll thereof along a clean, smooth, cutting line which defines a bordering edge of the severed sheet.

Another primary object of the present invention is to provide a cutting assembly which may be moved relative to a supply of material to be cut which is formed into an elongated supply roll wherein the sheet being dispensed therefrom may be cut to any desired length along a clean, smooth cutting line.

Yet another important object of the present invention is to incorporate a structural design in the cutting assembly of the present invention which allows it to be carried and efficiently manipulated by a single hand of a user.

Still another important object of the present invention is a cutting assembly which incorporates a cutting blade which is effectively shielded from exterior access thereby incorporating inherent safety features of the subject cutting assembly which prevents injury to the user thereof.

It is also an important object of the present invention to provide a cutting assembly which may be structurally modified to be used in combination with a conventional cutting or slicing instrument such that such instrument may be removably mounted on the cutting assembly in a cutting orientation while allowing movement or manipulation of the cutting assembly by the user gripping the outwardly extending portion of the conventional instrument once placed in the desired cutting orientation relative to the other structural components of the cutting assembly.

Yet another important object of the cutting assembly of the present invention is to incorporate a guide assembly therewith which is adapted to slidingly engage and move along a length of a supply roll of material being cut so as to properly orient a cutting blade of the cutting assembly, a consistent spaced distance relative to the supply roll and a sheet of material being cut therefrom.

Yet another object of the present invention is to provide a cutting assembly incorporating a structural design which is lightweight, durable to ensure a long operative life and which involves a reasonable cost of manufacture to facilitate commercial appeal of the device.

These and other objects, features and advantages of the present invention will become more clear when the drawing as well as the detail description are taken into consideration.

BRIEF DESCRIPTION OF THE DRAWINGS

For a fuller understanding of the nature of the present invention, reference should be had to the following detailed description taken in connection with the accompanying drawings in which:

FIG. 1 is a perspective view of a preferred base of the cutting assembly of the present invention;

FIG. 2 is a rear perspective view of a contact portion of a guide assembly associated with the cutting assembly of the present invention;

FIG. 3 is a side view of the embodiment of FIG. 1;

FIG. 4 is a front view of the cutting assembly of the present invention in assembled form and operatively positioned relative to a supply roll and a sheet of material to be severed therefrom;

FIG. 5 is a front view of an alternative embodiment of the cutting assembly of the present invention in assembled form;

FIG. 6 is a rear view of another embodiment of the present invention;

Like reference numerals refer to like parts throughout the several views of the drawings.

DETAILED DESCRIPTION OF THE PREFERRED EMBODIMENT

Figure 8:
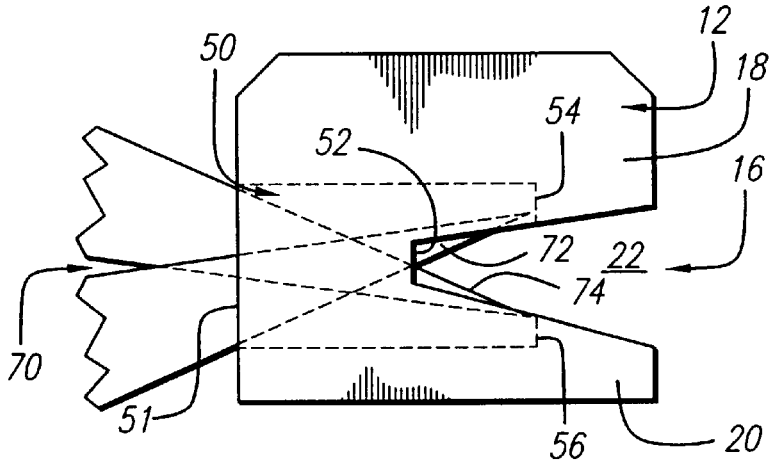
FIG. 8 is a side view of the embodiment of FIG. 6 in partial phantom with a conventional cutting instrument, other than that of FIG. 7, used in combination therewith.

The present invention is directed towards a cutting assembly, generally indicated as 10 in the accompanying Figures. More specifically, the cutting assembly 10 includes a base 12 preferably formed of durable, high strength, yet lightweight material and having an overall dimension and configuration so as to facilitate being carried and/or manipulated by one or more hands of the user of the device. To this end, the base 12 may be substantially narrow so as to facilitate gripping and storage thereof by a user, and/or may include one or more surface indentations 13 sized to receive one or more fingers of the user to facilitate gripping thereof. It should be noted that the base 12 can be configured to be gripped at a top and bottom or opposite sides thereof, depending on the comfort of a user, and as such, the indentations 13 may be oriented in a variety of configurations and locations so as to maximize the preferred gripping and manipulation of the base 12 by a user's hand. Alternately, although less preferred, the base 12 can be structured so as to be utilized in combination with a standing or fixed support frame or like structure which is intended to mount a supply roll 14 of paper or any other applicable material from which one or more sheets are repeatedly removed, as by cutting. Also, if desired, a substantially heavy duty assembly can be provided so as to facilitate the cutting of more heavy duty material sheets, such as wallpaper, roofing sheets, etc.

The base 12 includes a receiving portion, generally indicated as 16, preferably including an upper member 18 and a lower member 20 which may integrally define and/or be incorporated with the base 12. Furthermore, an opening 22 is preferably defined therebetween such that the receiving portion 16 may be considered to assume a fixed or adjustable "jaw-like" configuration. As illustrated in the figures, the opening 22 of the receiving portion 16 preferably includes a front opening 24 and two oppositely disposed side openings 26 and 28 so as to facilitate access through the opening 22 by an elongate sheet of material 14'. As will be explained in greater detail hereinafter the opening 22 that at least partially defines the receiving portion 16 is disposed and configured to receive a portion of the sheet of material 14' which is intended to be cut or severed from the supply roll 14. A cut remote from the leading edge 15 of the sheet of material 14' will be formed upon movement of the base 12 along the supply role 14.

To accomplish the actual cutting and resulting separation of the sheet of material 14' from the supply roll 14, one embodiment of the present invention, as best shown in FIGS. 3 and 4, includes the provision of a cutting blade 30, preferably fixedly mounted on the base 12 in a preferred, somewhat angled cutting orientation as shown. The term "fixed mounting" of the cutting blade 30 is meant to describe a relative fixed positioning of the blade 30 in the aforementioned cutting orientation. However, provision is provided for removable attachment as at 32 of the cutting blade 30 for purposes of repair or replacement. It is also important to note that the cutting blade 30 is positioned in the aforementioned preferred cutting orientation substantially within the receiving portion 16 such that it is protected or shielded from exterior access by fingers or other body portions of the user of the subject cutting assembly 10. This will prevent or at least seriously restrict inadvertent injury to the user or any other person by inadvertent exposure to the cutting blade. Such shielded positioning is further ensured by the fact that the dimension and configuration of the opening 22 limits the ability to inadvertently insert a finger or other body part within the opening 22 into contact with the cutting blade 30. This is particularly important when the cutting assembly 10 is used or accidently comes into the possession of younger children. Moreover, the cutting blade 30 is preferably disposed at an interior recess of the opening 22 such that as the sheet of material 14' is fed into the opening, preferably along a side edge of the sheet of material 14', it is guided by the receiving portion 16 into engagement with the cutting blade 30, and a continuous cut results with continuous movement of the base 12 across the sheet of material 14'.

Another feature of the present invention comprises the provision of a guide assembly. The guide assembly as shown in the accompanying figures includes a contact portion generally indicated as 40. The contact portion 40 is mounted, in the embodiment of FIGS. 1–5, by means of an outwardly projecting member or tongue 42 integrally or otherwise attached to preferably a rear surface 44 of the contact portion 40. The protruding tongue 42 is specifically dimensioned and configured to be press fitted or otherwise secured, such as by a clip, pin, hook and loop fastener, snap, screw, tongue and groove track, etc., to at least one side of the base 12, such as in the interior of an attachment or mounting opening as at 46 formed in at least one side of the base 12. As described in greater detail hereinafter, a preferred embodiment includes both sides of base 12 having openings as at 46 and 46', as shown in FIGS. 4 and 5, or some other structure for securement of the contact portion 40. In the illustrated embodiment, the secured but removable attachment of the protruding tongue 42 within the attachment opening 46 serves to secure the positioning of the contact portion 40 in its intended position, protruding outwardly from preferably a side of the base 12. However, in the embodiment shown in FIGS. 1–5, the inter engagement between the protruding tongue 42 and the attachment opening 46 is such as to allow relatively easy removal or detachment of the contact portion 40 therefrom for placement in the oppositely disposed mounting or attachment opening 46' formed on the opposite side of the base 12. A user of the subject cutting assembly 10 therefore has the choice of positioning the contact portion 40 of the guide assembly on either of the opposite sides of the base 12 so as to define at least two operative positions of the contact portion 40.

The exterior or exposed surface 48 of the contact portion 40 preferably includes a generally curvilinear configuration structured to at least partially correspond to the exterior, curved configuration as at 14" of the supply roll 14. With reference to FIG. 4, operative manipulation or positioning of the cutting assembly 10 is accomplished by the gripping of the base 12 and the proper positioning or orientation of a portion of the sheet 14' passing through the receiving portion 16. A leading edge or end 15 of the sheet 14' being cut protrudes outwardly from the opposite side 28 of the opening 22 relative to the side 26 through which it enters. The exterior surface 48 of the contact portion 40 is correspondingly configured relative to the exterior surface 14" of supply roll 14 to facilitate sliding engagement of the contact portion 40 as both the contact portion 40 and the base 12 are moved continuously along the entire length of the roll 14.

Therefore, a feature and advantage of the present invention is the cooperative structuring, disposition and configuration of the contact portion 40 and the cutting blade 30 so as to ensure maintenance of a substantially constant spacing of the cutting blade 30 relative to the exterior surface of the roll 14 and the maintenance of the cutting blade 30 in a proper cutting orientation relative to the positioning of the sheet 14' being cut from the roll 14 during the cutting process. Such a configuration generally ensures that a straight cut is achieved since the roll 14 itself typically defines a straight line.

Again with reference to FIGS. 4 and 5, another feature of the present invention is the positioning of the contact portion 40 of the guide assembly in either of at least two operative positions through the placement of the protruding tongue 42 of the preferred embodiment in either of the attachment openings 46 or 46' oppositely located to one another. Of course in other embodiments having different attachment structures such as clips or tracks, a similar structure is provided on both sides of the base 12 so as to achieve the opposite mounting orientations. This allows use of the cutting assembly 10 by either a right-handed or left-handed person and most efficiently facilitates the travel of the base 12 along the length of the supply roll 14 in either of two opposite directions. AS such, the opening 22 of the receiving portion 16 is structured to facilitate entrance of the portion 14' of the sheet being cut from either direction through side opening 26 or oppositely disposed side opening 28.

Figure 9:
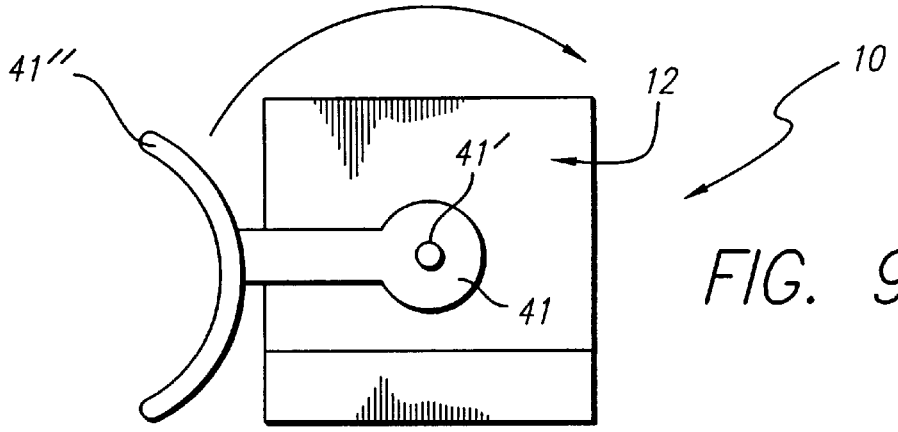
FIG. 9 is a rear view of yet another embodiment of the cutting assembly of the present invention.

Other embodiments to be incorporated within the cutting assembly of the present invention include the mounting of a second contact portion 40 to the base 12, such as within the oppositely disposed attachment opening 46' of the preferred embodiment, such that the cutting assembly would then comprise two such contact portions 40 and 40', as in FIG. 5. Yet another contemplated, alternate embodiment would be the movable but not necessarily removable attachment of a single contact portion 40" such that it may be selectively positioned in either of the two operative positions described above, such as by sliding through a track or pivoting about a central joint 41' of a handle 41 41, as in FIG. 9. Travel or movement of the base 12 and contact portion 40 along the length of the roll 14 in either of the two opposite directions would thereby be possible.

Figure 7:
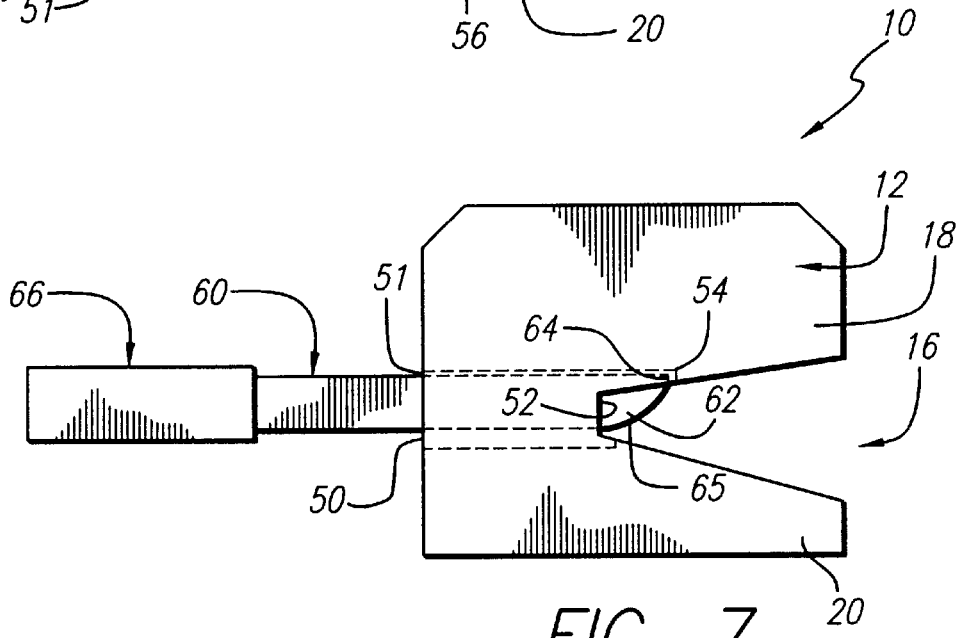
FIG. 7 is a side view of the embodiment of FIG. 6 with a conventional cutting instrument used in combination therewith.

Additional embodiments of the present invention are shown in FIGS. 6–8. More specifically, in the embodiment of FIG. 6, the base 12 includes a mounting or positioning channel or passage 50 having an open end as at 51 formed in the rear surface 13 of the base 12. The channel or passage 50 passes through the base 12 and has its opposite open end as at 52 disposed in communicating relation with the opening 22 of the receiving portion 16. The passage 50 is dimensioned and configured to allow removable insertion of at least the leading end of a cutting blade of a conventional cutting or slicing instrument which is generally represented as 60 in FIG. 7 and 70 in FIG. 8. In the embodiment of FIG. 7, the conventional cutting or slicing instrument 60 is in the form of a knife, letter opener or like instrument having an elongated configuration. A leading end of the cutting blade of the instrument 60 has a point or extremity 64 lodged against a receiving stop slot 54 formed on the interior of the base 12 adjacent the opening 52 of the passage or channel 50 as best shown in FIG. 7. With the point or extremity 64 wedged firmly in abutting engagement with the stop slot 54, at least a portion of the cutting edge as at 65 of the cutting blade 62 will be exposed and positioned in a cutting orientation relative to the receiving portion and any sheet of material 14' oriented therein for cutting. Further, in this embodiment, the opposite end of the instrument 60 generally indicated as 66 may include a handle or like structure to facilitate gripping of the instrument 60 by the user. By virtue of this gripping attachment of the instrument 60, the entire base 12 may be manipulated and positioned relative to its intended movement along the length of the supply roll 14 with the contact portion 40 positioned with regard to the description of the embodiments of FIGS. 1–5. Accordingly, in the embodiment of FIGS. 6, 7 and 8, a fixed cutting blade 30 is no longer required. Rather, a conventional instrument such as knife 60 or scissors 70 may be substituted for the cutting blade 30. The safety features of these embodiments are maintained because, when not in use, the conventional cutting instrument 60 or 70 or an instrument equivalent thereto can be removed from the base 12 so as to eliminate the possibility of an injury to children of extremely small ages.

With regard to FIG. 8, the base 12 is designed to receive two cutting blades 72 and 74 of a scissors type instrument, wherein the respective cutting edges are disposed in the proper cutting orientation relative to the receiving portion 16. In order to ensure a fixed but removable orientation or positioning of the blades 72 and 74, two stop slots as at 54 and 56 are provided such that the leading extremities or points of the blade 72 and 74 may be disposed in wedged or abutting relation relative to the stop slots 54 and 56 as clearly shown. Accordingly, in this embodiment the oppositely oriented blades 72 and 74 guide the sheet of material 14' into a cutting location as the base 12 is moved thereacross. Further, as with the embodiment of FIG. 7, the entire base 12 may be manipulated so as to travel along the length of the roll 14 through the gripping and manipulation of the exterior, rearwardly protruding portion of the scissors 70 (not shown for purposes of clarity). Of course, if desired the scissor or knife type assemblies may be incorporated as part of the device itself so as to facilitate grasping and manipulation thereof. Furthermore, as in FIG. 9, a separate elongate and/or contoured handle portion 41 of any of a variety of configurations can be provided so as to further aid gripping and manipulation of the base 12.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A cutting assembly designed to cut a sheet of material from a supply roll of such material, such cutting assembly comprising:

a) a base, b) a guide assembly disposed in operative engagement with said base, c) a receiving portion mounted on said base and comprising a jaw structure having spaced apart top and bottom members and an open front and open sides disposed therebetween, d) at least one cutting blade disposed substantially within said jaw structure in a shielded position relative to an exterior of said base, e) said guide assembly including at least one contact portion disposed in sliding engagement with the supply roll along a length thereof, and f) said contact portion disposed in spaced relation to said cutting blade and further disposed to maintain said cutting blade at a substantially constant spacing relative to the supply roll and a sheet of material being cut.

2. An assembly as recited in claim 1 wherein said contact portion is configured to facilitate sliding engagement with the supply roll.

3. An assembly as recited in claim 1 wherein said contact portion comprises a substantially curvilinear configuration substantially corresponding to an outer surface configuration of the supply roll.

4. An assembly as in claim 1 wherein said guide assembly is removably attached at least in part to said base.

5. An assembly as recited in claim 1 wherein said guide assembly includes an attachment structure connecting said contact portion to said base in at least two operative positions, each of said operative positions defining a disposition of said contact portion in sliding engagement with the supply roll while travelling in a different one of two opposite directions, while maintaining said cutting blade in said cutting orientation at said substantially constant spacing relative to the supply roll and the sheet of material being cut.

6. An assembly as in claim 5 wherein said contact portion is removably attached to said base and is selectively disposed thereon in either of said two operative positions.

7. An assembly as in claim 6 wherein said two operative positions are each defined by said contact portion extending outwardly from a different, substantially oppositely disposed side of said base.

8. An assembly as recited in claim 1 wherein said guide assembly is integral with said base.

9. An assembly as recited in claim 1 wherein said guide assembly comprises two contact portions each disposed in a different one of two operative positions, each of said operative positions disposed to define sliding engagement of a corresponding one of said contact portions along the length of the supply roll in a different one of two opposite directions, while maintaining said cutting blade in said cutting orientation and at said substantially constant spacing relative to the supply roll and the sheet of material being cut.

10. An assembly as recited in claim 1 wherein said open sides are substantially oppositely positioned relative to one another, each of said open sides being disposed and dimensioned to receive the sheet of material being cut therein.

11. An assembly as recited in claim 1 wherein said base and said guide assembly collectively comprise a sufficiently small dimension to be held in one hand of a user during cutting of the sheet material.

12. An assembly as recited in claim 1 wherein said cutting blade is removably mounted on said base and disposable into and out of said cutting orientation.

13. An assembly as recited in claim 1 wherein said cutting blade includes an elongated configuration extending at least partially outward from said base.

14. A cutting assembly designed to cut a sheet of material from a supply roll of such material, said cutting assembly comprising:

a) a base;

b) a guide assembly disposed in operative engagement with said base;

c) at least two cutting blades removably mounted on said base and positionable into and out of a cutting orientation; said two cutting blades being defined by interconnected cutting blades of a pair of scissors;

d) said guide assembly including at least one contact portion extending outwardly from said base in sliding engagement with the supply roll along a length thereof; and e) said contact portion mounted on said base in spaced relation to said two cutting blades and further disposed to maintain said two cutting blades at a substantially constant spacing relative to the supply roll and a sheet of material being cut.

* * * * *